US005216900A

United States Patent [19]

Jones

[11] Patent Number: 5,216,900

[45] Date of Patent: Jun. 8, 1993

[54] SOFT-SIDED COOLER WITH SOFT-SIDED FREEZE PACK

[76] Inventor: Charles E. Jones, 911 Fuchsia St., Oxnard, Calif. 93030

[21] Appl. No.: 813,991

[22] Filed: Dec. 27, 1991

[51] Int. Cl.[5] ..... F25D 3/08

[52] U.S. Cl. ..... 62/457.2; 62/371; 62/530; 224/148; 224/901; 224/242

[58] Field of Search ..... 62/457.1, 457.2, 457.7, 62/457.5, 371, 529, 530; 224/901, 148, 245, 242; 220/523; 190/111, 109

[56] References Cited

U.S. PATENT DOCUMENTS

| | | | |
|---|---|---|---|
| 3,406,532 | 10/1968 | Rownd et al. | 62/457 |
| 3,950,789 | 4/1976 | Konz et al. | 224/901 |
| 4,024,731 | 6/1977 | Branscum | 62/457 |
| 4,050,264 | 9/1977 | Tanaka | 62/457 |
| 4,375,828 | 3/1983 | Biddison | 150/2.1 |
| 4,441,336 | 4/1984 | Cannon | 62/457 |
| 4,605,006 | 8/1986 | Jacques | 62/530 |
| 4,630,671 | 12/1986 | Sherman et al. | 165/61 |
| 4,676,247 | 6/1987 | Van Cleve | 62/530 |
| 4,819,793 | 4/1989 | Willard et al. | 206/162 |
| 5,038,779 | 8/1991 | Barry et al. | 128/403 |

*Primary Examiner*—John M. Sollecito
*Attorney, Agent, or Firm*—Seldon & Scillieri

[57] ABSTRACT

A soft-sided cooler is disclosed having a pivotably fastenable lid and a soft-sided coolant pack dimensioned to fit snugly within the underside region of the lid. The underside region is defined by a plurality of generally opposing, inwardly facing sidewalls that extend downward towards the cooler body for fastening thereto when the lid is closed. The cooling pack comprises a matrix of coolant cells integrally formed within a compliant plastic sheet, and inserted within a fabric envelope. The envelope, in turn, bears Velcro fastening material which releasably retain the envelope within the underside of the lid by mating with VELCRO surfaces on at least a generally opposing pair of the sidewalls.

19 Claims, 3 Drawing Sheets

SOFT-SIDED COOLER WITH SOFT-SIDED FREEZE PACK

This is a continuation-in-part of my co-pending application Ser. No. PCTUS9004931, filed Aug. 30, 1990, the priority of which is claimed and the contents of which are hereby incorporated by reference.

BACKGROUND

1. Field of the Invention

This invention relates generally to portable refrigeration receptacles, and more particularly to soft-sided coolers of the picnic or lunch box type.

2. Prior Art

The invention herein is directed to a food beverage case commonly called a "fanny pack". These packs are generally bowed in appearance, and adapted to be attached about a user's waist by means of a belt or similar arrangement with the concave side of the bowed body fitting against the user's body. Naturally, "fanny packs" need not be bowed, although this is the common appearance.

Fanny packs are commonly worn by joggers, hikers, skaters, skiers and the like to transport a small amount of food and/or beverage. Because the pack is worn about the waist, it is near the user's center of gravity and is therefore less likely to affect the user's balance or posture than a knapsack, shoulder bag, etc. Moreover, it does not tire the hand or shoulder muscles as these other types of packs frequently do.

One deficiency of known fanny packs has been the lack of coolant within the pack to maintain the pack's contents at a lower-than-ambient temperature. Consequently, user's have been forced to consume warm beverages and melted candy bars when using the pack in warm weather. Because space is at a premium in these packs, there is little or no room for conventional coolant packs.

SUMMARY OF THE DISCLOSURE

In my above-referenced application, I describe a soft-sided cooler as having a pivotably fastenable lid and a coolant container dimensioned to fit snugly within the underside region of the lid. That region is defined by a plurality of generally opposing, inwardly facing sidewalls that extend downward towards the cooler body for fastening thereto when the lid is closed. The coolant container is retained within the underside of the lid by VELCRO fastening surfaces on the container which mate with VELCRO fastening surfaces on at least a generally opposing pair of the sidewalls.

One of the advantages of the foregoing configuration is that the coolant pack is placed in a thermally and spatially efficient location, thereby making a similar configuration optimal for a fanny pack. Since the fanny pack is frequently worn adjacent the small of the user's back, however, the presence of a solid, edged coolant pack may pose a hazard if fallen upon.

The invention herein comprises a soft-sided coolant pack particularly useful for fanny packs, as well as fanny packs having a soft-sided coolant pack utilizing the configuration set forth in my above-referenced patent application. As will be evident from the following description, the soft-sided coolant pack reduces the risk of injury arising from the user's falling on the pack, by providing a non-edged, more compliant configuration.

The soft-sided coolant pack comprises a matrix of coolant cells each consisting of an enclosure substantially filled with a re-usable coolant. The matrix is substantially encircled by an outer fabric layer.

The term "matrix" is used in its broadest sense to denote rows and/or columns of coolant cells in any configuration, and includes a single cell (i.e., a "1×1" matrix) as well as any other regular or irregular distribution of cells. Where the matrix comprises more than one cell, the cells are disposed on a sheet of flexible plastic and are preferably integrally formed with the sheet.

The coolant may be water or other suitable liquid. Preferably, an anti-freeze type of solution is used, wherein the liquid has a higher heat capacity than water, and a lower freezing point than water, thereby retaining its relatively compliant liquid form at temperatures reached in the user's freezer as the coolant is prepared for use.

The term "fabric" is also used herein in its broadest sense to denote any cloth-like material. The material is preferably in the form of a mesh, having spaces sized to accommodate heat conduction between the coolant cells and the interior of the fanny pack. One preferable mesh material is nylon. fanny pack. One preferable mesh material is nylon.

When used in the configuration described in my above-referenced patent application, the fabric layer is easily provided with one or more VELCRO strips suitable for engaging mating VELCRO surfaces on the interior lid of the pack.

It should also be recognized that the aforedescribed coolant pack is equally suitable for all type of coolers, and that its described use in fanny packs herein is not intended to be limiting.

The soft-side cooler herein comprises an enclosed, thermally insulated body having a cavity which defines an open-ended cold storage region for holding food and/or beverages. The cooler additionally includes a lid which is pivotably fastenable to the cooler body to close the open end of the cooler's cavity. The lid has an underside region defined by a plurality of generally opposing, inwardly facing sidewalls which extend towards the body of the cooler and fasten thereto to close the cavity.

The cooler additionally comprises the above-described softsided coolant pack, which is sized to fit snugly within the underside region of the lid. Means employing a pressure-sensitive, adherent fastening material, such as VELCRO, are provided to releasably retain the coolant pack within the underside region of the lid. One of the fastening surfaces is affixed to each of at least two generally opposing sidewalls. Mating fastening surfaces are secured to the coolant pack so as to contact, and mate with, the fastening surfaces on the sidewalls when the pack is placed within the lid's underside region. Because the mating fastening surfaces are highly resistant to relative lateral movement, the coolant pack is securely held within the lid's underside region regardless of the lid's position.

Because the mating fastening surfaces are relatively easily pulled apart, however, the coolant pack can be easily removed by pulling the lid's sidewalls away from the pack. Thus, the pack is easily removed from, and secured within, the underside region of the lid. Further, the coolant pack does not occupy any of the storage space occupied by the food and/or beverages. These and other details concerning my invention will be appreciated from the following detailed description of the preferred embodiment, of which the drawing forms a part.

DETAILED DESCRIPTION OF THE DRAWINGS

DESCRIPTION OF THE PREFERRED EMBODIMENT

Figure 1:
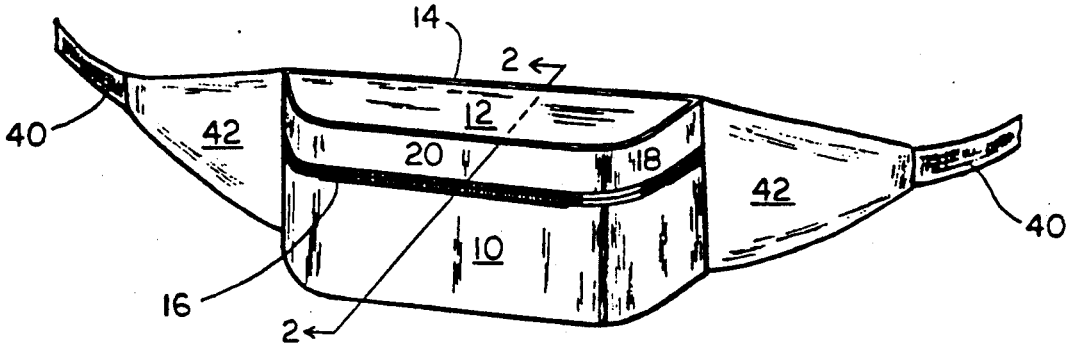
FIG. 1 is a perspective view of a fanny pack constructed in accordance with the invention.
Figure 2:
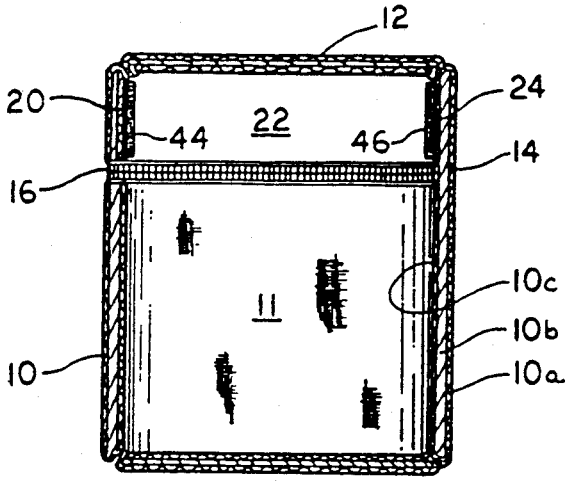
FIG. 2 is a cross-sectional view of the fanny pack, taken along line 2—2 in FIG. 1.

FIG. 1 is a perspective view of a fanny pack constructed in accordance with the invention. FIG. 2 is a cross-sectional view of the fanny pack, taken along line 2—2 in FIG. 1. Referring initially to FIGS. 1 and 2, the fanny pack cooler comprises a thermally insulated body 10 having a cavity 11 which defines an open-ended storage region. The storage region holds the food and/or beverages to be transported. As is known in the art, the cooler body 10 typically comprises a layer of thermally insulating foam 10*b* sandwiched between external layers 10*a,c* of polyethylene, nylon or other suitable material. In some cases, the cooler's cavity may be lined with a suitable fabric.

The fanny pack is configured to a user's waist, and is accordingly provided with a belt or strap 40 that is preferably adjustable in diameter and attached via wings 42 to the cooler body.

A lid 12 is pivotably fastenable to the cooler body 10 to close the open end of the cooler's cavity 11. The lid, conveniently formed of the same material as the cooler body, is integrally joined to the body 10 along a pivot axis 14 at the rear of the cooler. Naturally, the lid could be joined at the front or either side, and need not be integrally joined to the body. In practice, the external layer of material on the cooler body is simply extended beyond the top of the cooler body to form the exterior surface of the lid, while the liner along the rear wall of the cavity is extended upward to form the interior lid surface. The interjacent insulating layer, located in the lid and in the cavity body, is omitted along the pivot axis to give the region sufficient flexibility.

The lid 12 has an underside region encompassed by four generally opposing, inwardly facing sidewalls 18, 20, 22, 24 Which extend downward towards the cooler body when the lid is in the cavity-closing position. Fastening means, such as a zipper 16 are provided to releasably secure the leading downward edges of the lid's front sidewall 20, right sidewall 18 and left sidewall 22 to the cooler body's top left, top right and top front edges. The inner faces of the front and back sidewalls 20, 24 are lined with respective strips 44, 46 of pressure-sensitive, adherent fastening material, such as VELCRO, to secure a coolant pack, described below. For the sake of simplicity, the fastening material will hereinafter be referred to as VELCRO material, although it will be recognized that any similar pressure-sensitive, adherent fastening material, will suffice so long as the surface of material is highly resistant to relative lateral movement by a mating surface of the material while permitting numerous separations of the two surfaces without substantial loss of their fastening ability.

Figure 3:
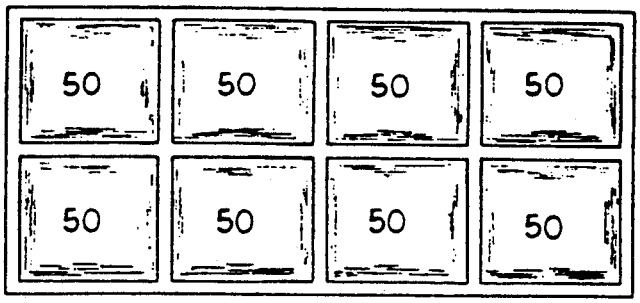
FIG. 3 is a top plan view of a matrix of coolant cells constructed in accordance with the invention
Figure 4:
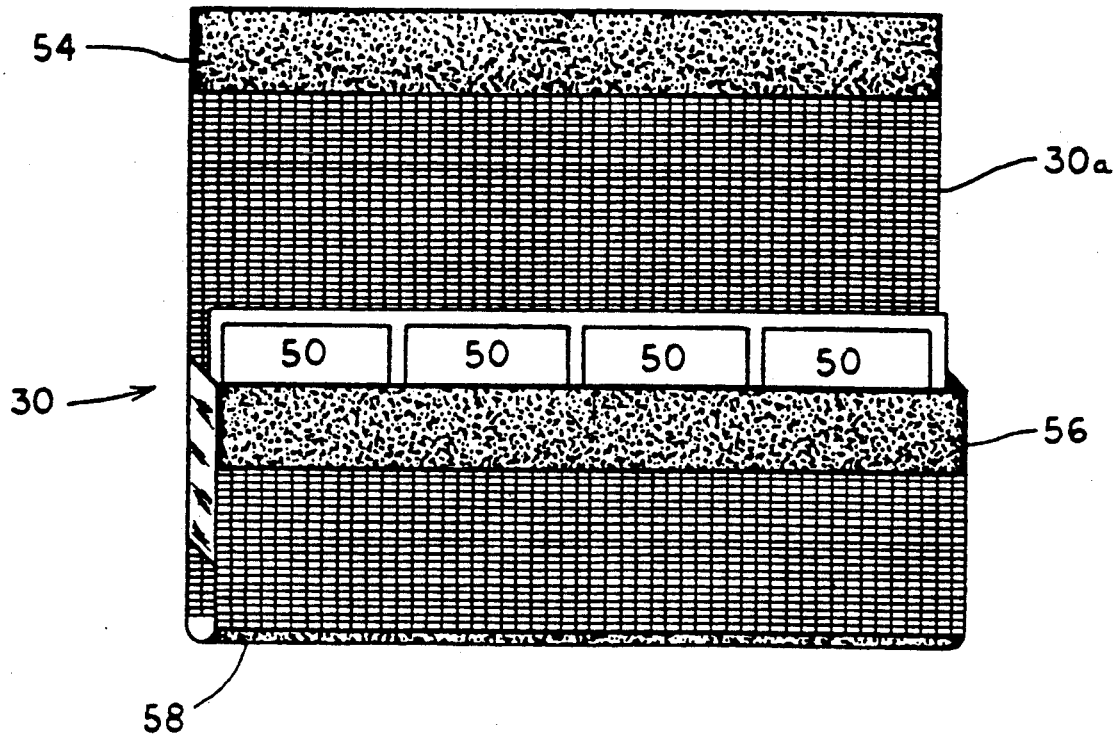
FIG. 4 is a back elevation view of a coolant pack constructed in accordance with the invention.
Figure 5:
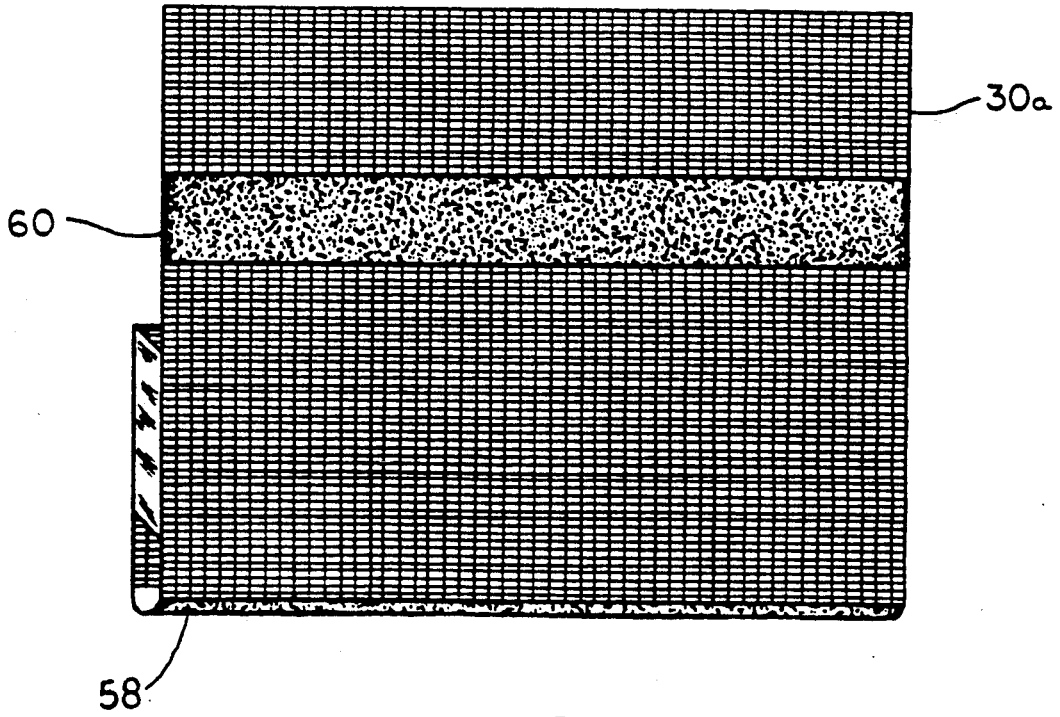
FIG. 5 is a front elevation view of the coolant pack of FIG. 4.

A coolant pack constructed in accordance with the invention is illustrated in FIGS. 3–5. FIG. 3 is a top plan view of a matrix of coolant cells constructed in accordance with the invention. FIGS. 4–5 are respectively the back and front elevation views of a coolant pack constructed in accordance with the invention.

Referring initially to FIG. 3, a $4\times2$ matrix of coolant cells is illustrated by way of example. The coolant cells 50 (only representative ones of which being numerically identified) are essentially packets of coolant integrally formed together as a soft plastic sheet. The sheet comprises at least two soft plastic layers, similar in texture to heavy plastic wrap, which are sealed to each other along a matrix of border lines separating the cells or packets. Coolant cells of this type are currently marketed by Reliable Industries (Middlesex, N.J.) under the trademark ICE-MAT.

The coolant itself may be water or other suitable liquid. Preferably, an anti-freeze type of solution is used, wherein the liquid has a higher heat capacity than water, and a lower freezing point than water, thereby retaining its relatively compliant liquid form at temperatures reached in the user's freezer as the coolant is prepared for use.

One or more matrices of coolant cells 50 are then placed within an outer fabric envelope 30 in accordance with the invention to form a coolant pack. Referring to FIGS. 4 and 5, which respectively illustrate back and front elevation views of the coolant pack, a suitable envelope of Nylon mesh fabric is shown with a matrix of coolant cells 50. The envelope's flap 30*a* is raised upwardly, and a matrix of coolant cells within the envelope is partially visible.

The flap 30*a* reversibly secures the matrix of coolant cells within the envelope. In the illustrated embodiment, the flap 30*a* is provided with a Velcro strip 54 along its edge which mates with a complementary Velcro strip 56 on the back of the envelope.

Figure 6:
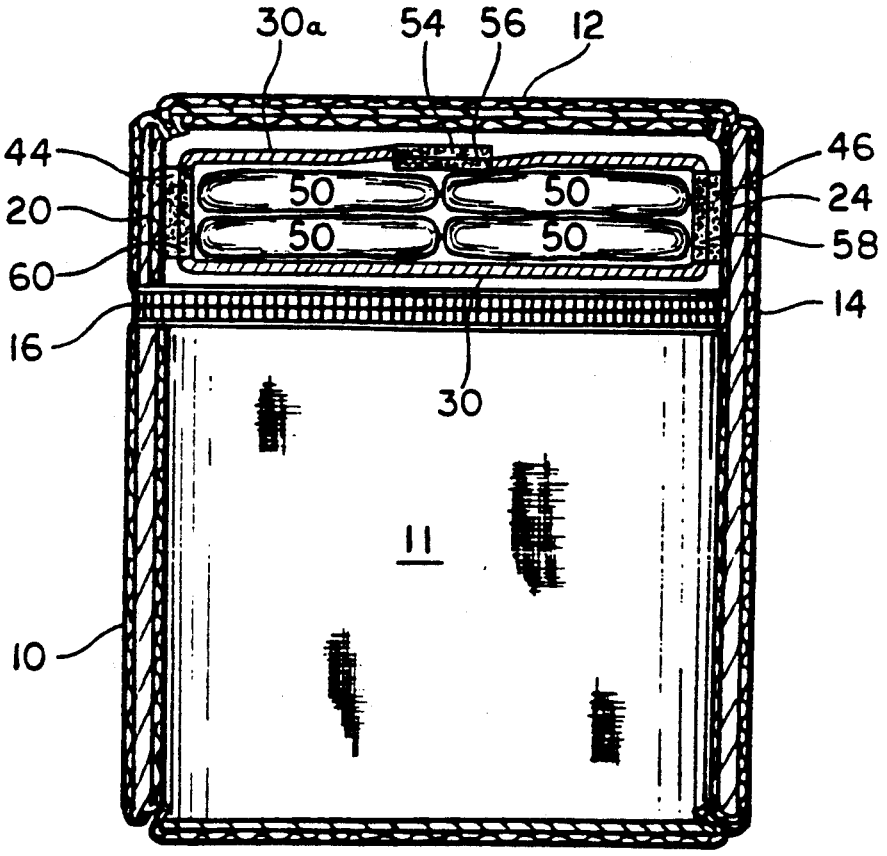
FIG. 6 is a cross-section view of the fanny pack similar to FIG. 2, but with the coolant pack inserted within the lid of the fanny pack.

As shown in FIG. 6, the envelope is dimensioned to fit snugly within and occupy substantially all of, the underside region of the fanny pack's lid. To engage the Velcro material 44, 46 (FIG. 2) within the fanny pack lid, the coolant pack is provided with Velcro strips 58, 60 on its top and bottom edge surfaces. It will be recognized that the closure of the flap 30*a* will result in the Velcro strip 60 being disposed along the top edge of the coolant pack, although it appears differently in FIG. 5 owing to the flap being open.

The fanny pack and coolant pack thus described avoids the usual "hard and rigid" freeze packs which could cause back injury, for example, if fallen upon by a roller skater or other wearer. Even if the aforedescribed coolant cells contain coolant which is solid when frozen, the relative movement between cells permitted by the plastic sheet and the lack of sharp edges will reduce the risk of such injuries.

Naturally, there are many variations and modifications which can be made without departing from the scope of my invention. While the foregoing description includes detail which will enable those skilled in the art to practice the invention, it should be recognized that the description is illustrative in nature and that many modifications and variations will be apparent to those skilled in the art having the benefit of these teachings. It is accordingly intended that the invention herein be defined solely by the claims appended hereto and that the claims be interpreted as broadly as permitted in light of the prior art.

I claim:

1. A soft-sided cooler comprising:

a thermally insulated body having a cavity defining an open-ended storage region;

a lid pivotably fastenable to said body to close the open end of the cooler cavity, the lid having an underside region defined by a plurality of generally opposing, inwardly facing sidewalls which extend downward towards the body for fastening thereto when the lid is in the cavity-closing position;

a coolant pack including a coolant cell matrix formed of a compliant material, said cell matrix having at least one cell holding a cooling medium, said coolant pack further including an outer fabric envelope holding said matrix, the envelope being sized to fit snugly within the underside region of the lid; and VELCRO fastening means including a pair of pressure-sensitive, adherent fastening surfaces, one of the fastening surfaces being affixed to each of at least two generally opposing sidewalls of said sidewall plurality, and the other of the fastening surfaces being secured to the envelope to contact the first surfaces so that the coolant pack is removably secured against movement into the storage region when the lid is in the cavity-closing position.

2. The cooler of claim 1 wherein the envelope includes a releasibly securable flap permitting insertion and removal of the matrix.

3. The cooler of claim 1 wherein the envelope is formed from a mesh material.

4. The cooler of claim 3 wherein the mesh material is Nylon.

5. The cooler of claim 1 wherein the coolant cell matrix is a complaint sheet-like structure of integrally formed coolant cells.

6. The cooler of claim 1 wherein the coolant cells are substantially filled with a liquid solution having a freezing point below the temperature to which the cells are lowered when in a common household freezer.

7. The cooler of claim 1 wherein the envelope is formed from a mesh material and includes a releasibly securable flap permitting insertion and removal of the matrix, and the coolant cell matrix is a compliant sheet-like structure of integrally formed coolant cells substantially filled with a liquid solution having a freezing point below the temperature to which the cells are lowered when in a common household freezer.

8. The cooler of claim 7 wherein the coolant pack is dimensioned to be snugly encompassed by the plurality of sidewalls extending from the lid.

9. The cooler of claim 8 wherein the coolant pack is dimensioned to lie essentially wholly within the underside region of the lid so as not to extend into the storage region when the lid is in the cavity-closing position.

10. The cooler of claim 9 wherein the said other fastening surface is a pair of strips that extends along opposite edges of the coolant pack.

11. The cooler of claim 1 wherein the said other fastening surface is a pair of strips that extends along opposite edges of the coolant pack.

12. A coolant pack for use in a portable cooler and comprising:

a coolant cell matrix formed of a compliant material, said cell matrix having at least one cell holding a cooling medium; and an outer fabric envelope for holding said matrix, said envelope having an internal matrix-holding cavity defined between major opposing faces and a circumferentially extending edge region disposed between the major faces when the envelope is inserted within the cooler, the envelope further including VELCRO fastening means material disposed along at least portions of the edge region oppositely positioned about the circumference of the envelope to reversibly adhere to complementary VELCRO fastening means surfaces within the portable cooler.

13. The coolant pack of claim 12 wherein the envelope includes a releasibly securable flap permitting insertion and removal of the matrix.

14. The coolant pack of claim 12 wherein the envelope is formed from a mesh material.

15. The coolant pack of claim 14 wherein the mesh material is Nylon.

16. The coolant pack of claim 12 wherein the coolant cell matrix is a compliant sheet-like structure of integrally formed coolant cells.

17. The coolant pack of claim 12 wherein the coolant cells are substantially filled with a liquid solution having a freezing point below the temperature to which the cells are lowered when in a common household freezer.

18. The coolant pack of claim 12 wherein the envelope is formed from a mesh material and includes a releasibly securable flap permitting insertion and removal of the matrix, and the coolant cell matrix is a complaint sheet-like structure of integrally formed coolant cells substantially filled with a liquid solution having a freezing point below the temperature to which the cells are lowered when in a common household freezer.

19. The coolant pack of claim 12 wherein the major opposing faces include a front face and a back face, the front face being integrally coupled to a flap portion, the flap portion having a proximal end region where it is coupled to the front face, and a distal end portion, the coolant pack further including means for releasibly securing the flap portion to the back face of the envelope to substantially enclose the matrix-holding cavity, the envelope further including a VELCRO fastening means surface disposed along at least a portion of the proximal end region so that the VELCRO fastening means surface is positioned at the circumference of the envelope when the distal flap portion is secured to the back face of the envelope.

* * * * *